United States Patent [19]

Morris et al.

[11] Patent Number: 4,937,899

[45] Date of Patent: Jul. 3, 1990

[54] LAVATORY WITH IMPROVED OVERFLOW DUCT ASSEMBLY

[75] Inventors: Steven A. Morris, Knoxville; Jerry L. Roberts, Sevierville, both of Tenn.

[73] Assignee: JPI Plumbing Products, Inc., Ann Arbor, Mich.

[21] Appl. No.: 195,710

[22] Filed: May 18, 1988

[51] Int. Cl.[5] ..... E03C 1/24

[52] U.S. Cl. ..... 4/651; 4/619

[58] Field of Search ..... 4/651, 619, 198–202, 4/631; 428/198

[56] References Cited

U.S. PATENT DOCUMENTS

| | | | |
|---|---|---|---|
| 2,413,811 | 1/1947 | Coordes | 4/651 |
| 3,859,675 | 1/1975 | Van Manen et al. | 4/206 X |
| 4,440,821 | 4/1984 | Komura et al. | 4/651 X |

FOREIGN PATENT DOCUMENTS

| | | | |
|---|---|---|---|
| 659419 | 10/1951 | United Kingdom | 4/651 |

*Primary Examiner*—Charles E. Phillips

*Attorney, Agent, or Firm*—Harness, Dickey & Pierce

[57] ABSTRACT

An improved lavatory sink assembly having an overflow duct preferably made of plastic. In a preferred manufacturing process, surface coatings are first applied to the bowl and thereafter adhesives such as a hot-melt glue and a room temperature vulcanizing material are applied to the sink bowl. The overflow duct is then applied to the sink bowl. This assembly process eliminates problems associated with spot welding of metal overflow ducts and enables a uniform layer of coating to be applied to the sink bowl surfaces.

3 Claims, 3 Drawing Sheets

LAVATORY WITH IMPROVED OVERFLOW DUCT ASSEMBLY

BACKGROUND AND SUMMARY OF THE INVENTION

This invention relates to an improved lavatory sink assembly and particularly to one having an overflow duct adhesively bonded to the lavatory sink bowl.

Lavatory sinks of the type widely used in residential and commercial settings include an overflow port which permits the sink to be filled to a predetermined level and then provides an overflow passage which drains the water to prevent the bowl from overfilling.

Lavatory sinks are typically made from stamped sheet metal. Durable surface coatings such as porcelain enamel are applied to the exposed inside surface of the sink bowl and its outside surface. These coatings improve the appearance of the sink, enable it to be easily cleaned, and provide corrosion protection. A typical present design for a lavatory sink assembly includes an overflow duct separately formed from sheet metal which is spot welded to the stamped sink bowl prior to the application of surface coatings. Although such prior art configurations perform satisfactorily, they have a number of shortcomings. Spot welding of the overflow duct can cause spot welding marks in the finished sink which are cosmetically undesirable. The area of the spot welds further has a tendency of preventing good adhesion of the surface coating which can cause the enamel to flake or pop off over time. Spot welding requires clean metal surfaces and therefore the components must be welded together prior to surface coating. The irregular surface formed by the fabricated assembly is difficult to uniformly coat with enamel, and further, some areas such as the inside of the overflow duct are shielded and cannot be easily coated, thus leading to the potential for corrosion problems. And, finally, spot welding by itself does not provide a leak free joint between the duct and bowl, and therefore separately applied sealant or heavy surface coatings are required.

In view of the foregoing, there is a need to provide an improved lavatory sink assembly which avoids the above outlined problems of prior art designs. The improved lavatory sink assembly according to the present invention employs an overflow duct, preferably made from molded plastic, which is affixed to the lavatory sink bowl using adhesives. The assembly in accordance with the present invention is preferably fabricated using a manufacturing process in which the lavatory bowl is first coated on both its inside and outside surfaces without the overflow duct in place, enabling the bowl to be uniformly and completely covered. Thereafter, the overflow duct is bonded to the sink bowl. With this assembly technique, problems associated with the cosmetic appearance and corrosion of spot welded assemblies are obviated.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
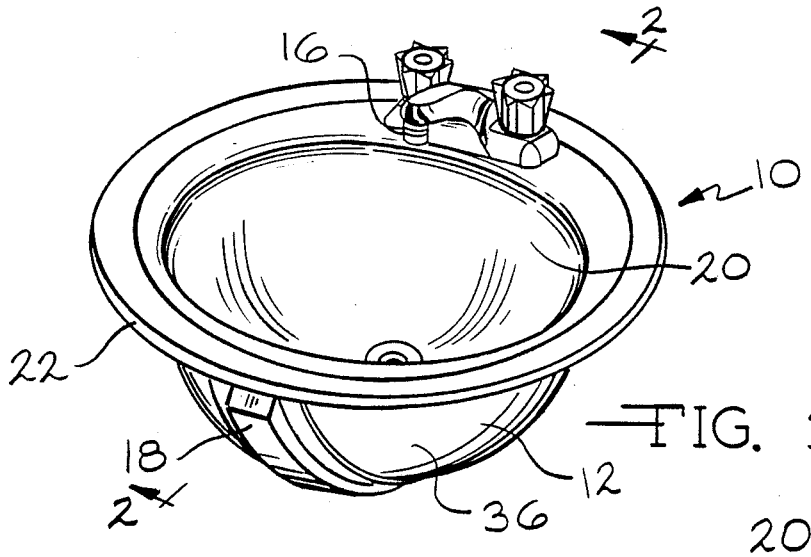
FIG. 1 is a pictorial view of an improved lavatory bowl assembly according to the present invention.

An improved lavatory sink assembly in accordance with this invention is shown in FIG. 1 and is generally designated there by reference number 10. Sink assembly 10 principally comprises sink bowl 12, drain assembly 14, faucet assembly 16, and overflow duct 18.

Sink bowl 12 forms a concave inside bowl surface 20 with a peripheral extending flange 22 which seals against a counter top (not shown). Drain aperture 24 is located in a local depression 26. Overflow port 28 is positioned to drain water once bowl 12 is filled to a predetermined level. Faucet assembly 16 provides hot and cold water controls and is mounted to sink bowl 12 through suitable apertures (not shown).

Figure 2:
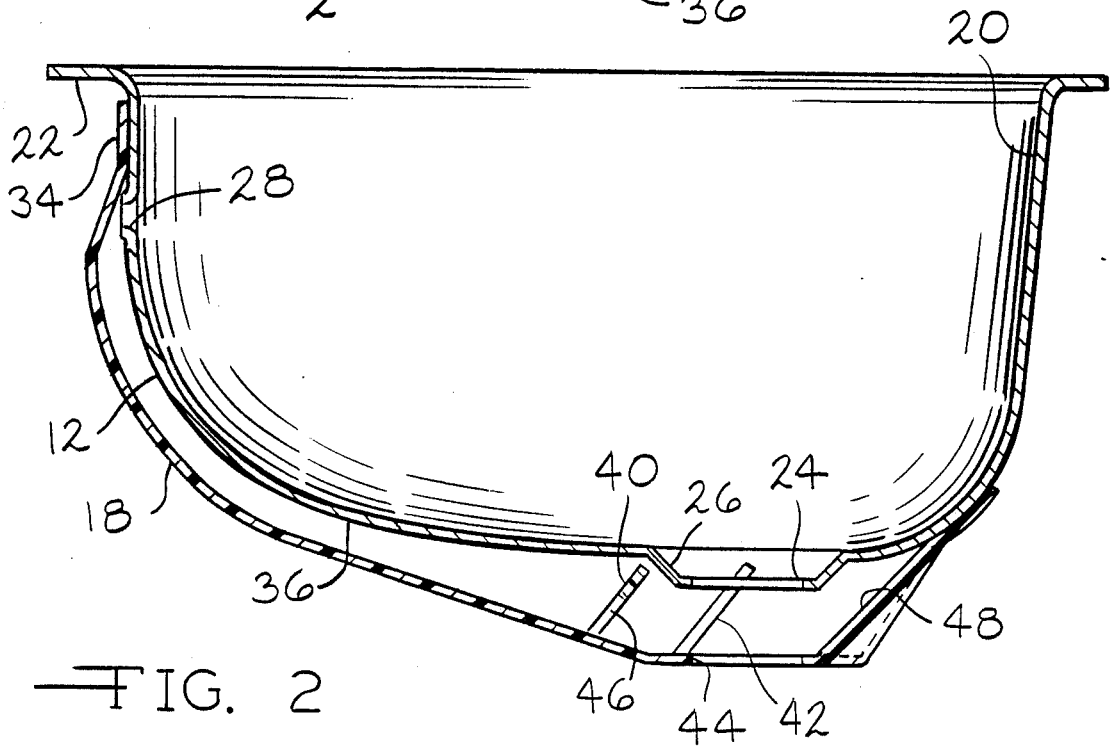
FIG. 2 is a cross-sectional view of the bowl assembly shown in FIG. 1 taken along lines 2—2.
Figure 3:
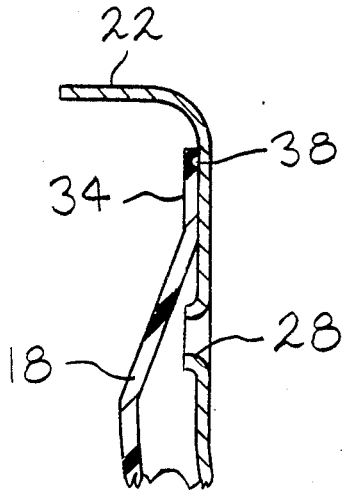
FIG. 3 is an enlarged partial cross-sectional view taken from FIG. 2.
Figure 4:
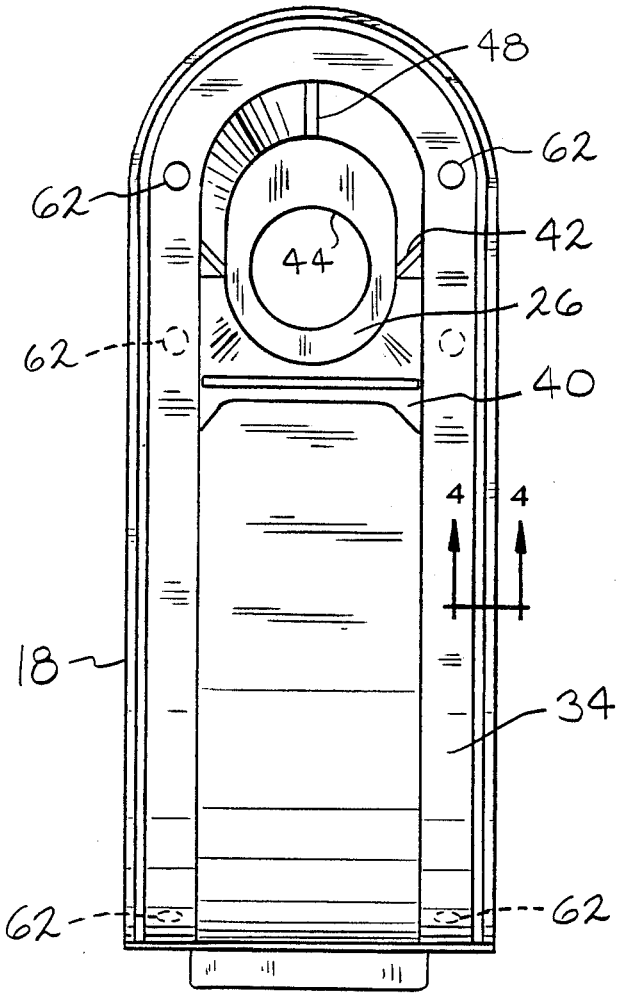
FIG. 4 is a bottom view of the overflow duct according to this invention.
Figure 5:
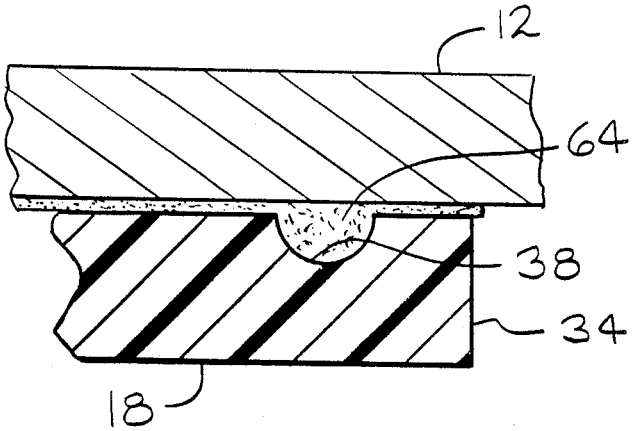
FIG. 5 is a cross-sectional view taken along line 4—4 but showing the overflow duct flange attached to the sink bowl.
Figure 6:
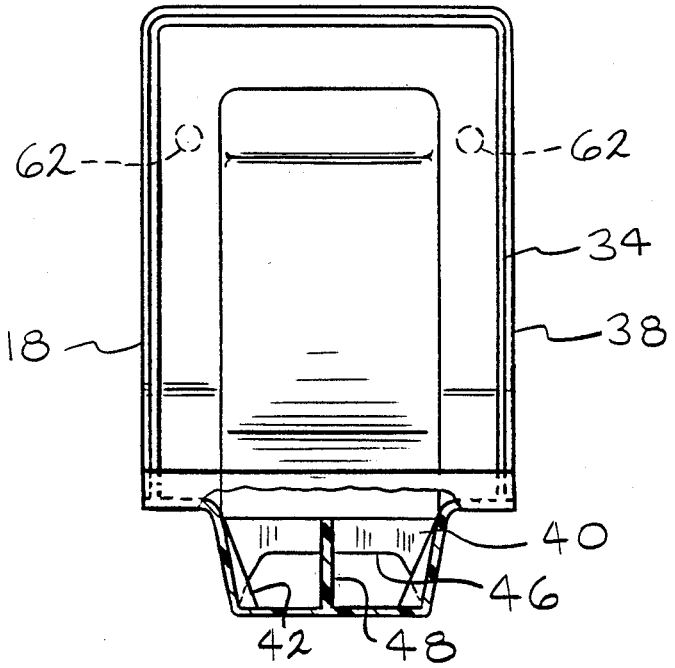
FIG. 6 is a rear-view and partial section of the overflow duct according to this invention.

Overflow duct 18 is of generally trough shape (FIGS. 1 and 2) extends between and covers overflow port 28 and drain aperture 24 and has a peripheral flange 34, which closely conforms with the exterior surface 36 of sink bowl 12. As best shown in FIG. 5, flange 34 forms a sealant groove 38 for retention of a bonding and sealant material, as will be explained below. The portion of overflow duct 18 adjacent drain aperture 24 is reinforced by ribs 40, 42 and 48. Rib 40 has a cut-out lower passage 46 for water flow. Duct drain aperture 44 is located coaxially with bowl drain aperture 24. Duct 18 is preferably made of a plastic material such as PVC, formed through injection molding processes.

In an assembly process particularly adapted for sink assembly 10, sink bowl 12 is first coated with appropriate coatings on both the inside and external surfaces, 20 and 36. A base or ground coat may be applied to the inside and outside surfaces, and a final porcelain overcoat may be applied only to the exposed internal surface 20. During assembly, it is necessary to quickly and securely position overflow duct 18 in place. In accordance with this invention, several drops 62 of hot-melt adhesive are applied for rapid bonding. Since hot-melt adhesives generally do not provide adequate long term bonding strength when used for the present application, another bonding and sealing compound such as room temperature vulcanizing (RTV) materials may be used. RTV sealant 64 is deposited along the entire periphery of flange 34. Groove 38 retains a bead of sealant 64 to prevent it from being completely "squished out" from the interface between sink bowl 12 and duct 18. RTV material requires at least several hours to solidify, and therefore the immediate bonding capability of hot-melt glue drops 62 retains the parts together during curing. Both drops 62 and RTV sealant 64 may be applied by automated equipment directly to sink bowl 12 just prior to mounting duct 18. Drops 62 are applied to flange 34 at positions inboard of the bead of sealant 64 so as not to interfere with the continuity of the sealant bead.

Figure 7:
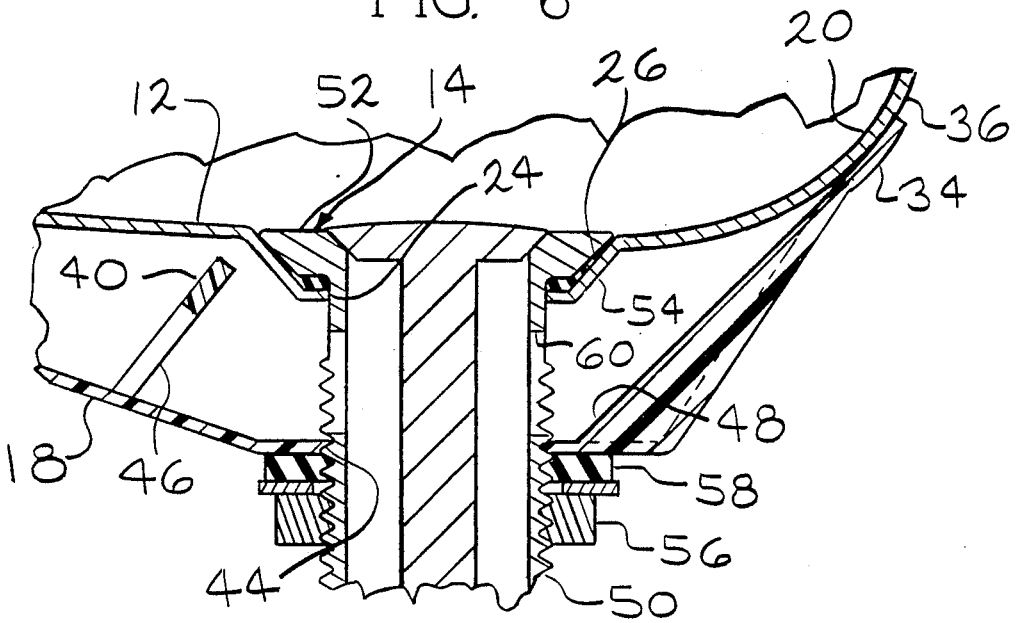
FIG. 7 is a partial cross-sectional view showing the drain assembly mounted to the sink assembly according to this invention.

After duct 18 is affixed to bowl 12, drain assembly 14 is mounted within drain apertures 24 and 36, as shown in FIG. 7. Standpipe 50 extends through the apertures and includes a flared upper end 52 which seals around drain aperture 26 through compression of gasket 54. The outer surface of standpipe 50 is threaded, enabling fastening nut 56 to compress against gasket 58 and the outer surface of overflow duct 18. Ports 60 are provided so that water flowing into overflow duct 18 will flow into and out of standpipe 50. The reinforcement provided by ribs 40 and 42 enable overflow duct 18 to have sufficient rigidity to enable gasket 58 to be compressed against the duct to form a seal.

While the above description constitutes the preferred embodiments of the present invention, it will be appreciated that the invention is susceptible to modification, variation and change without departing from the proper scope and fair meaning of the accompanying claims.

We claim:

1. A lavatory sink assembly comprising:

a sheet metal sink bowl having an outside surface and a concave inside surface for receiving and retaining water, said bowl also having a lower drain aperture and an overflow aperture positioned along a side surface of said sink and spaced above said drain aperture, said sink bowl further having a surface coating applied to both said inside surface and said outside surface, a substantially trough shape overflow duct for attachment to said outside surface at a position extending between said overflow aperture and said drain aperture, said duct having a peripheral flange conforming to said outside bowl surface, hot-melt glue drops applied to said sink bowl outside coated surface for retraining said overflow duct in position on said sink bowl, and a bead of room temperature vulcanizing material applied between said duct peripheral flange and said bowl outside surface, whereby said hot-melt glue drops retain said duct in position while said room temperature vulcanizing material cures.

2. A lavatory sink assembly according to claim 1 wherein said flange defines a sealant retention groove for retaining said room temperature vulcanizing material.

3. A lavatory sink assembly according to claim 1 wherein said hot-melt glue drops are deposited on said flange inboard of said bead of room temperature vulcanizing material.

* * * * *